United States Patent [19]

Manahan

[11] Patent Number: 4,586,492

[45] Date of Patent: May 6, 1986

[54] THERAPEUTIC BED

[76] Inventor: Antonio P. Manahan, 6901 N. 72nd St., Omaha, Nebr. 68122

[21] Appl. No.: 521,440

[22] Filed: Aug. 8, 1983

[51] Int. Cl.[4] ..... A61H 1/00; A47C 20/04

[52] U.S. Cl. ..... 128/33; 74/51; 5/109; 5/433; 128/49

[58] Field of Search ..... 128/25 R, 25 B, 33—36, 128/31, 39, 41, 44–46, 48, 49, 51, 52, 56, 57, 67; 188/32; 74/89, 17, 89.18, 40, 51, 422; 366/111; 272/73, 134, 900; 5/60–65, 108, 109, 423, 449, 453, 433, 462, 464, 469; 269/328, 325, 60, 69; 297/337, 338, 345, 346, 423, 429, 374, 375, 377, 452

[56] References Cited

U.S. PATENT DOCUMENTS

| | | | |
|---|---|---|---|
| 2,179,442 | 11/1939 | Wolz | 74/26 |
| 2,311,542 | 2/1943 | Holme | 5/62 |
| 2,655,915 | 10/1953 | Brand | 128/33 |
| 2,869,538 | 1/1959 | Hawk | 128/33 |
| 3,200,416 | 8/1965 | Warrick | 5/62 |
| 3,238,798 | 3/1966 | Yeasting | 74/26 |
| 3,434,165 | 3/1969 | Keane | 128/134 |
| 3,814,414 | 6/1974 | Chapa | 269/328 |
| 3,916,882 | 11/1975 | Jameson | 128/24 |
| 3,972,081 | 8/1976 | Stern | 5/60 |
| 4,107,797 | 8/1978 | Maxwell | 5/60 |
| 4,175,550 | 11/1979 | Leininger | 128/33 |
| 4,188,677 | 2/1980 | Zur | 5/66 |
| 4,356,577 | 11/1982 | Taylor | 128/33 |
| 4,494,259 | 1/1985 | Miller | 5/64 |

OTHER PUBLICATIONS

Rotorest Mark III Kenetic Treatment Table by Kenetic Concepts, Inc.

*Primary Examiner*—Clyde I. Coughenour

[57] ABSTRACT

A therapeutic bed for treating medical complications of immobility oscillates in a circular rhythmic fashion, an upper frame being caused to pivot about its central longitudinal axis with respect to an intermediate frame which is caused to pivot about its central lateral axis with respect to a base frame. Independent mechanical means having variable speed controls each employ a rotating eccentric arm which oscillates the respective pivoting frame. Shock absorbers provide smooth motion.

6 Claims, 5 Drawing Figures

THERAPEUTIC BED

TECHNICAL FIELD

The present invention relates generally to treating medical complications arising out of patient immobility. More particularly it relates to a novel and improved therapeutic bed which provides for rhythmic rocking of the patient.

BACKGROUND ART

The result of immobility resulting from head injury, quadriplegia, paraplegia, and various other disabilities often results in pressure sores, as well as gastrointestinal, musculosketal, genitourinary, pulmonary and cardiovascular disorders.

For many years the only known treatment for such immobility was periodic lifting and turning of the patient by nursing personnel or, if the patient was convalescing at home, by family members. The usual disadvantages of hand labor are self-evident in so far as they are common to any manually performed task and need not be enumerated.

A recent development in the treatment of immobility-related trauma is a treatment table which oscillates back and forth about its central longitudinal axis. This therapy has proven superior to manual lifting and turning in terms of being a labor saving device and better providing for unreliability in meeting schedules. However, to accomplish maximum results, it has generally been a requirement of the single axis oscillation table that the patient be turned, both left and right, to an angle exceeding 45° with the horizontal. As a consequence, complex heavy padding surrounding the patient's limbs, torso, and head are usually required. Restraining straps must generally be used to maintain the padding in position.

All of the above-related accoutrements, in addition to the mechanical provisions for the wide turning arc, add to manufacturing and maintenance costs. In addition the tolerance of many patients to such extreme tipping has proven to be somewhat limited. To some it is difficult to sleep under treatment, for others it sometimes causes sea sickness.

DISCLOSURE OF THE INVENTION

An object of the present invention is the provision of an improved device for treating and preventing complications of immobility.

A further object is to provide a device which is superior in its curative and preventative effect on immobile patients than either manual lifting and turning or single axis oscillating treatment tables.

Another object of the present invention is the provision of a low cost therapeutic bed.

In a more general sense, it is an object of this invention to provide a therapeutic bed which oscillates in a rhythmic fashion, most nearly analogized to a boat at anchor rolling in a gentle sea. This pattern of oscillation is accomplished by structure which pivotally supports a mattress-supporting upper frame along its longitudinal axis on an intermediate frame which, in turn, is pivotally supported along its lateral axis on a base frame. Additionally, independently powered mechanism is provided to cause the intermediate frame to oscillate about its lateral axis and the upper frame to oscillate about its longitudinal axis.

A somewhat circular motion is the result of combining these longitudinal and lateral oscillations. A pivoting angle of no more than 20° along either axis ordinarily will achieve excellent curative and preventative results.

The less extreme but circular oscillations of the present invention promote relaxation in contrast to the single axis oscillating table. No special padding is required and the additional cost of the therapeutic bed thereover is not excessive.

An additional use of the present invention results from the fact that its longitudinal and lateral oscillatory motions can be independently controlled. For instance, in the case of patients having bed sores, wounds or post-operative lesions primarily along one side, the speed of longitudinal oscillation causing pressure on that side can be slowed down, leaving the primary motion one about the lateral axis. Also, with the particular structure provided in the instant invention it is possible to commence oscillating along one axis or the other and then stop the motion about that particular axis, thus leaving the spring and mattress canted. Oscillation along the other axis can then be effected.

These and other objects, advantages, and novel features of the present invention will become apparent from the following detailed description of the invention when considered in conjunction with the accompanying drawings.

BEST MODE FOR CARRYING OUT THE INVENTION

Figure 1:
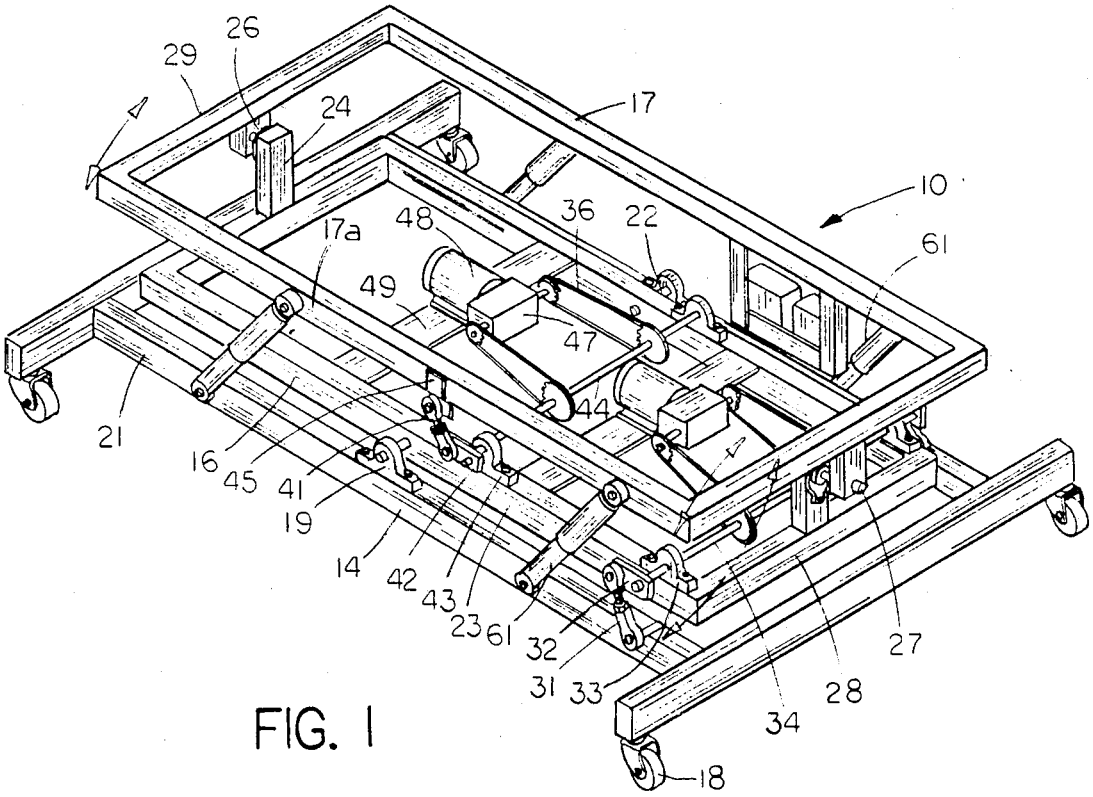
FIG. 1 is a perspective view showing only the functional structure of the present invention without a mattress thereon.
Figure 2:
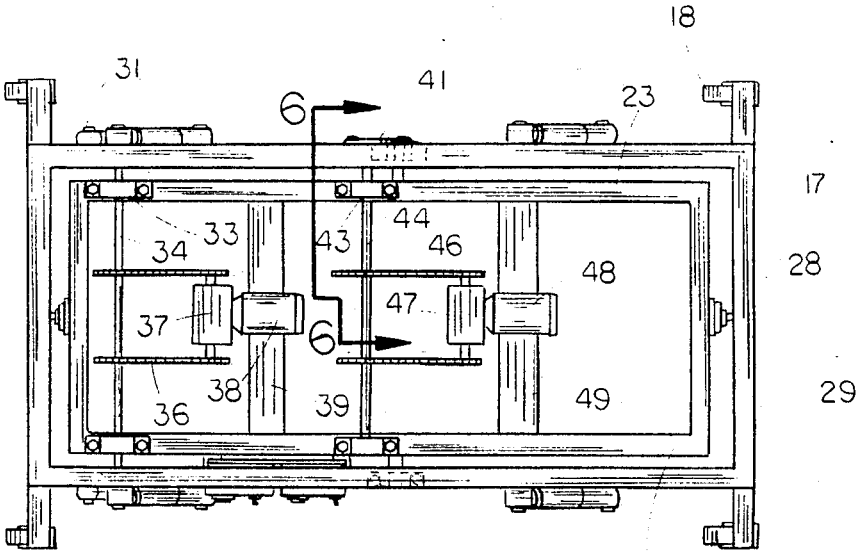
FIG. 2 is a top plan view of the portion of the invention showing in FIG. 1.
Figure 3:
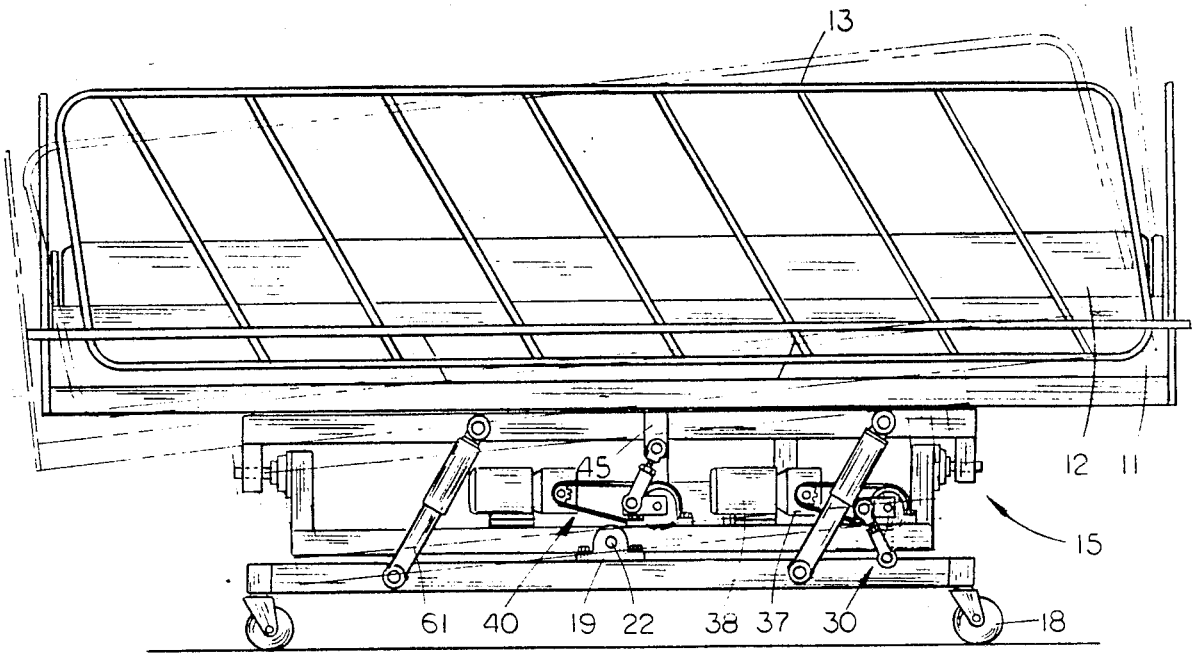
FIG. 3 is a side elevational view of the present invention.
Figure 4:
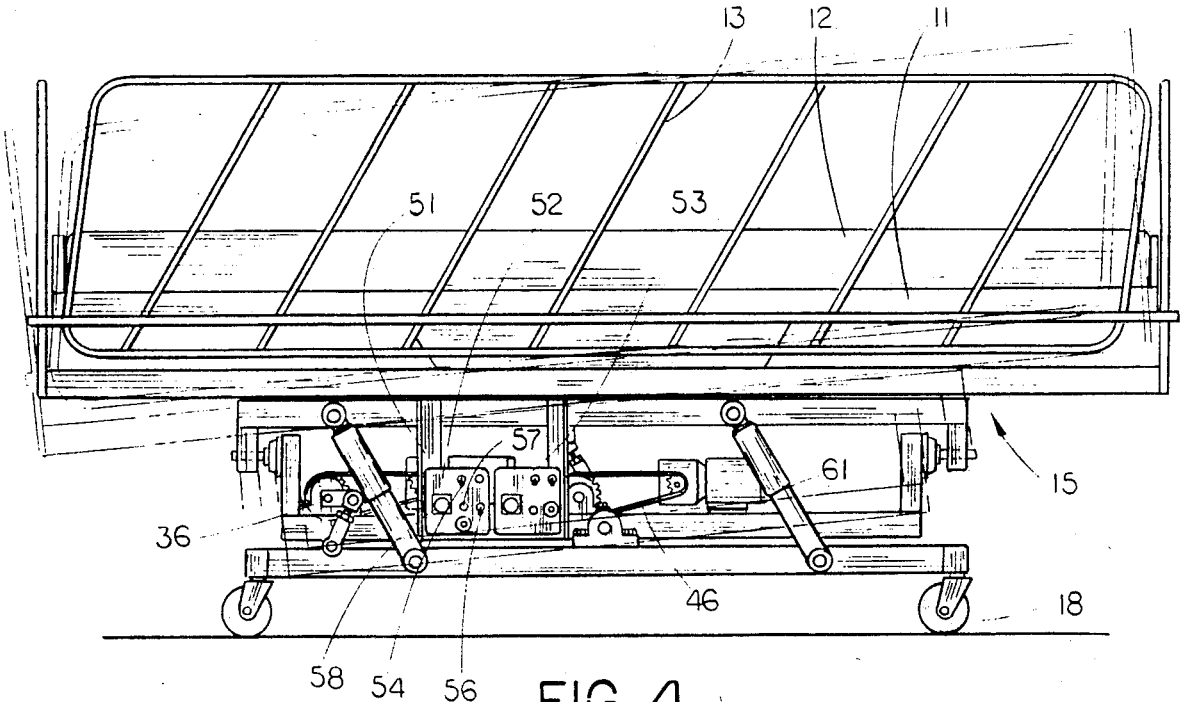
FIG. 4 is a side elevational view of the present invention of the opposite side to that shown in FIG. 3; and, FIG. 5 is an end view of the present invention of that end which is at the left in FIG. 3.
Figure 5:
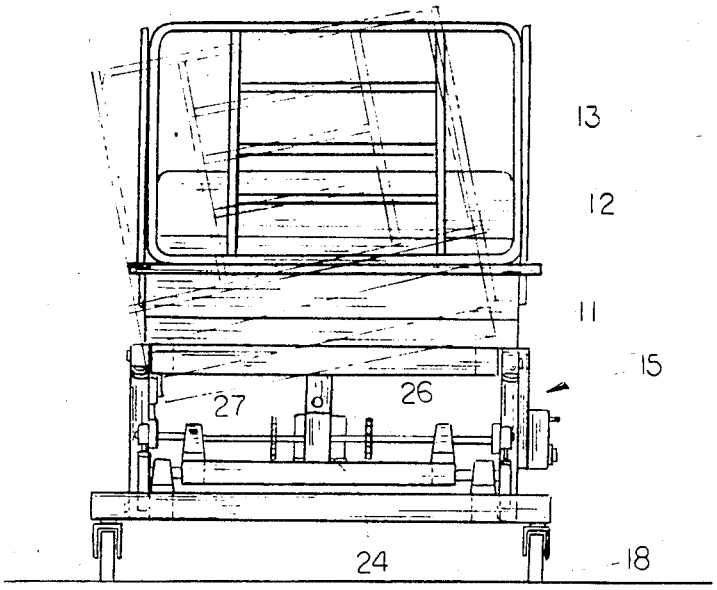

Referring now to the drawings wherein like reference numerals designate identical or corresponding parts throughout the several views, and more particularly to FIG. 1, whereon the functional structure of the present invention is designated generally at (10) and includes base frame (14), intermediate frame (16), and upper frame (17). Other elements of the therapeutic bed are indicated generally at (15) on FIGS. 3, 4, & 5 and include bed spring frame (11), mattress (12) and security bars (13). All three frames (14), (16), and (17) are generally open, rectangular structures, the outer dimensions of intermediate frame (16) being less than the inner dimensions of either base frame (14) or upper frame (17).

In a manner to be explained later, intermediate frame (16) is caused to oscillate about its central lateral axis and upper frame (17) is caused to oscillate about its central longitudinal axis. By virtue of the fact that base frame (14) has interior dimensions large enough to permit the encroachment of intermediate frame (16) within it, intermediate frame (16) may be lower than otherwise. As a consequence, mattress (12) may be at an elevation above the floor equivalent to that of conventional hospital beds. Base frame (14) is fitted with 4 corner castors

(18) to allow manual maneuvering of therapeutic bed (15).

Pivot blocks (19), each of which is secured to the upper side of each longitudinal member (21) of base frame (14) at about its midpoint, and pivot pins (22) (see also FIGS. 3 and 4), each of which is affixed normal to either longitudinal member (23) of intermediate frame (16) at about its midpoint, cooperate in a conventional manner to provide for the pivotal attachment of intermediate frame (16) to base frame (14). An upwardly projecting pivot block (24) is attached to either of the two lateral sides (28) of intermediate frame (16) at its midpoint and a depending pivot block (26) is attached to either of the two lateral sides (29) of upper frame (17) at its midpoint. Pivot pin (28) (see also FIG. 5) projects inwardly from and normal to depending block (26) for pivotal attachment to block (24). Thus, the pivotal support of upper frame (17) by intermediate frame (16) is provided for.

To effect oscillation of intermediate frame (16), intermediate frame oscillating assembly (30) is provided. Referring to FIGS. 1 through 4, the main components of intermediate frame oscillating assembly (30) are comprised of double pivot link (31), eccentric arm (32), bearing block (33), shaft (34), chain and sprocket assembly (36), gear reduction box (37), motor (38), and motor support (39). To avoid having bulky, more expensive parts and yet support the weight of both intermediate frame (14) and upper frame (16), double pivot link (31), eccentric arm (32), bearing block (33), and chain and sprocket assembly (36) are duplicated on either side of one end of functional structure (10).

One end of each double pivot link (31) is journaled to the outer side of longitudinal member (21) of base frame (14) to a conventional manner and its other end is pivotally attached to an end of eccentric arm (32) whose other end is rigidly attached to one end of shaft (34) which bears within the two bearing blocks (33). The duplicated elements of assembly (30) are at the opposite side of functional structure (10). Chain and sprocket assemblies (36) transmit power between shaft (34) and gear reduction box (37). Power is supplied by electric motor (38) which is mounted onto motor support (39) which in turn is affixed to and spans between the two longitudinal members (23) of intermediate frame (16). As shaft (34) is turned through 360° by motor (38), eccentric arm (32) will cause double pivot link (31) to cycle left and right twice for each turn and, as a consequence, oscillate intermediate frame (16) with respect to base frame (14).

To effect oscillation of upper frame (17), upper frame oscillating assembly (40) is provided. The major components of upper frame oscillating assembly (40) which have their counterparts in intermediate frame oscillating assembly (30) are: double pivot link (41), eccentric arm (42), pivot block (43), shaft (44), sprocket and chain assembly (46), gear reduction box (47), motor (48), and motor support (49). In addition, upper frame oscillating assembly (40) includes bearing bracket (45) which depends from longitudinal member (17*a*) of upper frame (17) near its midpoint and approximately over the adjacent outer edge of intermediate frame (16).

In a manner similar to that of intermediate frame oscillating assembly (30), the oscillation of upper frame (17) is effected by the interconnection of its elements. However, it should be appreciated that there can be no duplication of parts on both sides of intermediate frame (16) and upper frame (17) of the counterparts which are duplicated in intermediate frame oscillating assembly (30). This is due to the fact that the spatial relationship between the longitudinal members of intermediate frame (16) and upper frame (17) is constantly changing as oscillation occurs. Rather, provision must be made at the point where double pivot link (41) is connected to depending bracket (45) to accommodate the slight change in angle between the two as bracket (45) is raised and lowered. It has been found that, in the preferred embodiment, the use of a conventional rod end bearing for the pivoting function of double pivot link (41) provides sufficient play at said point to obviate any undue problems of bending or wear.

As in the case of intermediate frame oscillating assembly (30) power is supplied by electric motor (48) which is mounted onto motor support (49) which in turn is affixed to and spans between the two longitudinal members (17*a*) of upper frame (17). As shaft (44) is turned by motor (48), eccentric arm (42) will cause double pivot link (41) to oscillate upper frame (17) with respect to intermediate frame (16).

The operation of therapeutic bed (15) is controlled at control center (50) (best seen in FIG. 4), its major components comprising mounting frame (51), intermediate frame control box (52), and upper frame control box (53). In this embodiment mounting frame (51) is suspended from longitudinal member (17*a*) of upper frame (17) so as to be convenient to nursing personnel. It is to be understood that a parallel control center (not shown) or a singular control center could be provided in other locations, such as for convenient use by patients having adequate motor function. As it is an obvious advantage of the present invention to reduce or eliminate the cost and other shortcomings of nursing care, locating the control center for control by patient is an additional advantage. Each control box (42) and (53) is provided with an on-off switch (54), a stop-start switch (56), an operating signal light (57), and a variable speed control (58).

Therapeutic bed (15) can be operated either at a lateral or a longitudinal slant with oscillation in the other direction, or at a circular wave-like roll with both lateral and longitudinal oscillatory motions proceeding simultaneously. It may be medically preferable to use one of the former motions in situations where bed sores or ulcerations are predominantly located on one side or one portion of a patient's body. In other situations, such as where pulmonary problems are present, it is possible to maintain a fore to aft cant of intermediate frame (16) while oscillating upper frame (17) laterally. Otherwise, the latter motion, that of a circular, wave-like roll, is the principle use of the present invention for treating complications of immobility.

To achieve any desired angle of cant, either motor (38) or motor (48), whichever is appropriate, is turned on by on-off switch (54). Then motion is initiated by stop-start switch (56) until the appropriate frame is at that angle. Stop-start switch (56) is then moved to the stop position. Appropriate switches on the other control box may then be employed in an obvious manner to start the motor and initiate oscillatory motion. Variable speed control (58) is then adjusted in accordance with the required therapy. It should be appreciated that the speed of each oscillatory motion may be controlled through each speed control dial (58), allowing for variable combining of longitudinal and lateral motion as desired by the treating physician.

In this embodiment shock absorbers (61) are connected between base frame (14) and upper frame (17) on either side of and fore and aft of functional structure (10). Shock absorbers (61) serve to eliminate any uneven or jerky motion of upper frame (17). As a result, therapeutic bed (10) provides a very relaxing and secure feeling to the patient, promoting his psychological well being as well as providing necessary therapy.

Accordingly it is believed that all the objects mentioned above are accomplished by use of the best mode for carrying out invention disclosed herein. Obviously, many modifications and variations of the present invention are possible in light of the above teachings. It is therefore to be understood that, within the scope of the appended claims, the invention may be practiced otherwise than as specifically described.

What is claimed is:

1. A therapeutic bed, comprising:
a rectangular base frame adapted to rest on a floor;
a rectangular intermediate frame substantially centered above said base frame, said intermediate frame journaled thereto for pivoting about its lateral axis;
a rectangular upper frame adapted to support a mattress substantially centered above said intermediate frame, said upper frame journaled thereto for pivoting about its longitudinal axis;
means for selectively controlling the angle of said intermediate frame with respect to said base frame; and
means for oscillating the pivoting of said intermediate frame with respect to said base frame, which includes:
first power means, which is mounted on said intermediate frame and turns a shaft having a link pivotally and eccentrically attached thereto and is pivotally attached at its other end to said base frame; and
means for oscillating the pivoting of said upper frame with respect to said intermediate frame, which includes:
second power means, which is mounted on said intermediate frame and turns a shaft having a link pivotally and eccentrically attached thereto and is pivotally attached at its other end to said upper frame.

2. The therapeutic bed of claim 1, wherein said upper frame oscillating means further includes means for controlling its speed and for selectively starting and stopping it and said intermediate frame oscillating means further includes means for controlling its speed, whereby the frequency of the rolling action is independently variable as to each axis.

3. The therapeutic bed of claim 1, wherein starting and stopping means and speed control means for said first and second power means are mounted on said intermediate frame.

4. The therapeutic bed of claim 3, wherein said base frame and said upper frame are of open rectangular construction generally equivalent in size and said intermediate frame is rectangular in shape and has dimensions slightly less than those of the openings in said base frame and said upper frame, whereby said intermediate frame along with the power means, starting and stopping means and speed control means mounted on it may fit within said base frame and said upper frame during said longitudinal and lateral pivoting, thereby allowing said upper frame to be at a minimal height.

5. The therapeutic bed of claim 4, further comprising one or more shock absorbers, pivotally connected at either end between said base frame and said upper frame.

6. A therapeutic bed, comprising:
a rectangular base frame adapted to rest on a floor;
a rectangular intermediate frame substantially centered above said base frame, said intermediate frame journaled thereto for pivoting about its lateral axis;
a rectangular upper frame adapted to support a mattress substantially centered above said intermediate frame, said upper frame journaled thereto for pivoting about its longitudinal axis;
means for oscillating the pivoting of said intermediate frame with respect to said base frame, which includes:
first power means, which is mounted on said intermediate frame and turns a shaft having a link pivotally and eccentrically attached thereto and is pivotally attached at its other end to said base frame; and
means for selectively starting and stopping said first power means; and
means for oscillating the pivoting of said upper frame with respect to said intermediate frame, which includes:
second power means, which is mounted on said intermediate frame and turns a shaft having a link pivotally and eccentrically attached thereto and is pivotally attached at its other end to said upper frame, whereby said upper frame may be tilted forward or aft about its lateral axis at a desired angle and then oscillated about its longitudinal axis.

* * * * *